US005749712A

United States Patent [19]

Umemura

[11] Patent Number: 5,749,712

[45] Date of Patent: May 12, 1998

[54] VARIABLE DISPLACEMENT SWASH PLATE TYPE COMPRESSOR

[75] Inventor: Yukio Umemura, Yokohama, Japan

[73] Assignee: Calsonic Corporation, Tokyo, Japan

[21] Appl. No.: 712,604

[22] Filed: Sep. 13, 1996

[30] Foreign Application Priority Data

Sep. 14, 1995 [JP] Japan ..... 7-237087
Nov. 27, 1995 [JP] Japan ..... 7-307748

[51] Int. Cl.[6] ..... F09B 1/14

[52] U.S. Cl. ..... 417/269; 92/12.2; 74/60

[58] Field of Search ..... 74/60; 92/12.2, 92/71; 417/222.2, 269

[56] References Cited

U.S. PATENT DOCUMENTS

| | | | |
|---|---|---|---|
| 4,433,596 | 2/1984 | Scalzo | 92/12.2 |
| 4,506,648 | 3/1985 | Roberts | 92/12.2 |
| 4,688,439 | 8/1987 | Cureton et al. | 74/60 |
| 4,712,982 | 12/1987 | Inagaki et al. | 417/269 |
| 4,727,761 | 3/1988 | Scalzo | 74/60 |
| 4,846,049 | 7/1989 | Terauchi | 92/12.2 |
| 4,886,423 | 12/1989 | Iwanami et al. | 417/222 |
| 4,911,064 | 3/1990 | Drevet | 92/71 |
| 5,364,232 | 11/1994 | Kimura et al. | 417/222.1 |

FOREIGN PATENT DOCUMENTS

| | | |
|---|---|---|
| 0 102 691 | 3/1984 | European Pat. Off. . |
| 43 33 408 | 5/1994 | Germany . |
| 2-31234 | 7/1994 | Japan . |

*Primary Examiner*—Timothy Thorpe
*Assistant Examiner*—Peter G. Korytnyk
*Attorney, Agent, or Firm*—Foley & Lardner

[57] ABSTRACT

A variable displacement swash plate type compressor has a coupling structure between a drive shaft and a swash plate in order to allow the swash plate to be movable along the drive shaft and inclinable relative to the same. The coupling structure comprises a bearing portion provided on the drive shaft to rotate therewith. The bearing portion includes first and second semicylindrical outer walls which are symmetrically arranged with respect to an axis of the drive shaft and first and second flat side walls which are symmetrically arranged with respect to the axis. Each of the first and second semicylindrical outer walls is perpendicular to each of the first and second flat side walls. The bearing portion further includes a rectangular center bore formed in a hub portion of the swash plate. The center bore is so sized and shaped as to intimately and slidably receive therein the bearing portion.

18 Claims, 12 Drawing Sheets

VARIABLE DISPLACEMENT SWASH PLATE TYPE COMPRESSOR

BACKGROUND OF THE INVENTION

1. Field of the Invention

The present invention relates in general to compressors for use in an automotive air conditioning system or the like, and more particularly to compressors of a variable displacement swash plate type. More specifically, the present invention is concerned with a coupling structure which inclinably connects a swash plate to a drive shaft while achieving a simultaneous rotation of them.

2. Description of the Prior Art

In order to clarify the task of the present invention, two conventional compressors of the above-mentioned type will be described with reference to FIGS. 15 to 17 of the accompanying drawings.

One of the conventional compressors is shown in FIG. 15, which is generally designated by reference numeral 1A. As shown, the compressor 1A comprises a swash plate 43 which is disposed about a drive shaft 11 to rotate therewith assuming an inclined position relative thereto. That is, for achieving such rotation of the swash plate 43, a sleeve 61 with a pair of pins 64 is slidably disposed on the drive shaft 11, and a hub portion of the swash plate 43 is pivotally connected to the pins 64. A coil spring 80 is disposed about the drive shaft 11 to bias the sleeve 61 rightward in the drawing.

A plurality of pistons 16 are incorporated with corresponding cylinder bores 12*a* which are arranged at evenly spaced intervals about an axis of the drive shaft 11. Each piston 16 comprises a head portion 17 which is slidably received in the cylinder bore 12*a* and a stem portion 18 which is exposed to a crank chamber 13. The stem portion 18 has a shoe holder portion which comprises two holding arms by which two semi-spherical shoes 19*a* and 19*b* are slidably held. The shoes 19*a* and 19*b* slidably put therebetween a peripheral part of the swash plate 43. Thus, when, due to rotation of the, the swash plate 43 is rotated assuming a certain inclined position relative to the drive shaft 11, each piston 16 is forced to make reciprocating movement in the corresponding cylinder bore 12*a*. Thus, a refrigerant vapor in the cylinder bore 12*a* is compressed.

A supporting bracket 41 is secured at a base portion thereof to the drive shaft 11 to rotate therewith. The supporting bracket 41 has at a leading end a drive arm 42. A driven arm 44 is secured to the swash plate 43. The driven arm 44 has a pin 46 secured thereto, which pin is slidably received in an elongate slot 45 formed in the drive arm 42. Thus, a torque of the drive shaft 11 is transmitted to the swash plate 43 through the supporting bracket 41, the drive arm 42, the pin 46 and the driven arm 44.

Thus, during rotation together with the drive shaft 11, the swash plate 43 can slide along the drive shaft 11 varying the inclination angle thereof relative to the drive shaft 11.

Designated by reference "Cv" is a pressure regulating valve which is installed in the compressor 1A. Due to operation of the valve "Cv", the pressure in the crank chamber 13 is controlled, which varies the inclination angle of the swash plate 43 relative to the drive shaft 11 and thus varies the stroke of each piston 16 thereby regulating the displacement of the compressor 1A.

However, due to inherent construction, the above-mentioned conventional compressor 1A has the following drawbacks.

(1) A so-called pivot pin type coupling structure is employed for coupling the swash plate 43 with the drive shaft 11, which includes the sleeve 61 and the two pins 64 secured to the sleeve 61. Due to employment of such type coupling structure (61, 64), the number of parts of the compressor 1A is increased, which induces an increase in production cost of the compressor 1A.

(2) Due to nature of such pivot pin type coupling structure, a play tends to occur in the structure, which causes generation of noises.

The other of the conventional compressors is a compressor disclosed in Japanese Patent Second Provisional Publication 2-31234, which is partially shown in FIGS. 16 and 17 as being designated by reference numeral 1B. In this conventional compressor 1B, there are no parts corresponding to the sleeve 61 and the pins 64 of the above-mentioned compressor 1A of FIG. 15. That is, in the compressor 1B, a so-called pinless type coupling structure is employed in place of the pivot pin type coupling structure of FIG. 15.

As is shown in FIGS. 16 and 17, in the coupling structure of the compressor 1B, a center bore 54 is formed in a hub portion of the swash plate 53, through which the drive shaft 11 passes. As shown, the center bore 54 is so shaped as to permit an inclination of the swash plate 53 relative to the drive shaft 11. FIG. 16 shows a condition wherein the swash plate 53 is largely inclined relative to the drive shaft 11, while FIG. 17 shows a condition wherein the swash plate 53 is not inclined.

The bore 54 comprises a front side bore part 54*a* and a rear side bore part 54*b* which are merged at an imaginary crossing plane 71 which passes through inwardly projected portions (or ridges) 54*c* and 54*d* defined in the bore 54. When the swash plate 53 is inclined relative to the drive shaft 11, the projected portions 54*c* and 54*d* serve as fulcrums.

However, even the compressor 1B having the above-mentioned pinless type coupling structure has the following drawbacks.

(1) The center bore 54 has a complicated form. Machining such complicated bore 54 in the swash plate 53 needs a very skilled and expensive technique, which thus causes increase in production cost of the compressor 1B.

(2) Due to the ridges (viz., inwardly projected portions) 54*c* and 54*d* against which the drive shaft 11 slidably abuts, marked abrasion tends to occur at the ridges 54*c* and 54*d* and portions of the drive shaft 11 which abut the ridges 54*c* and 54*d*. Such abrasion causes a play of the swash plate 53 and thus causes generation of noises in the compressor 1B. If the abrasion becomes much severe, smoothed pivoting of the swash plate 53 relative to the drive shaft 11 is not achieved.

(3) Due to nature of the pinless type coupling structure, the imaginary crossing plane 71 has an oval cross section. Thus, when the swash plate 53 assumes an intermediate position between the maximally inclined position of FIG. 16 and the non-inclined position of FIG. 17, a certain clearance is inevitably produced between the drive shaft 11 and each of the upper and lower ends of the inner wall of the center bore 54. Such clearance tends to promote the undesired play of the swash plate 53.

SUMMARY OF THE INVENTION

It is therefore an object of the present invention to provide a variable displacement swash plate type compressor which is free of the above-mentioned drawbacks.

According to the present invention, there is provided a variable displacement swash plate type compressor which comprises a casing having a plurality of cylinder bores circumferentially arranged therein; a plurality of pistons incorporated with the cylinder bores respectively; a drive shaft extending in the casing; a swash plate disposed about the drive shaft; a hinge mechanism for achieving a hinged connection between the drive shaft and the swash plate; means for making a hinged and slidable connection between the swash plate and each of the pistons to make a reciprocating movement of each piston when the swash plate is rotated together with the drive shaft; a coil spring disposed about drive shaft for biasing the swash plate in a given direction; and a coupling structure arranged between the drive shaft and the swash plate in order to allow the swash plate to be movable along the drive shaft and inclinable relative to the same, the coupling structure including: a bearing portion provided on the drive shaft to rotate therewith, the bearing portion including first and second semicylindrical outer walls which are symmetrically arranged with respect to an axis of the drive shaft and first and second flat side walls which are symmetrically arranged with respect to the axis, each of the first and second semicylindrical outer walls being perpendicular to each of the first and second flat side walls; and means defining a center bore in a hub portion of the swash plate, the center bore being so shaped and shaped as to intimately and slidably receive therein the bearing portion.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
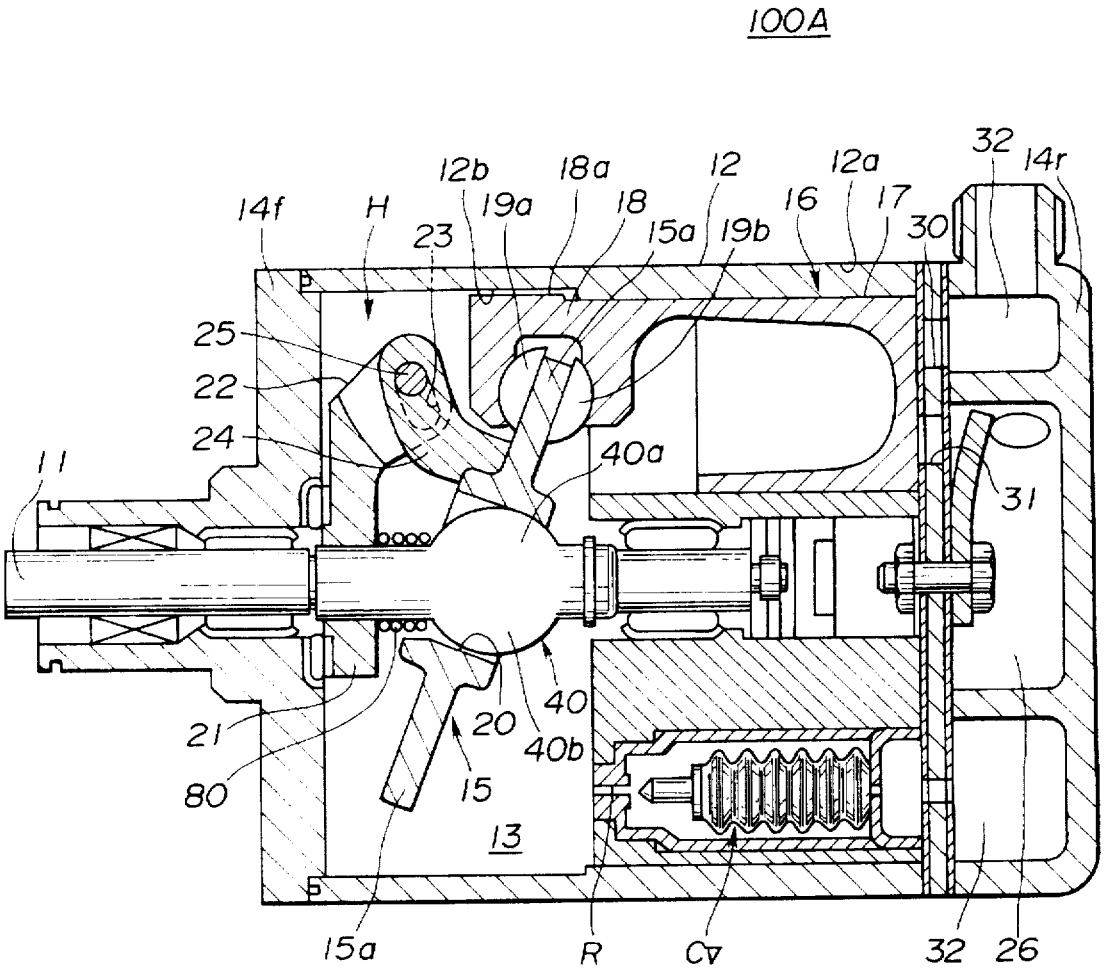
FIG. 1 is a sectional view of a variable displacement swash plate type compressor which is a first embodiment of the present invention.
Figure 2:
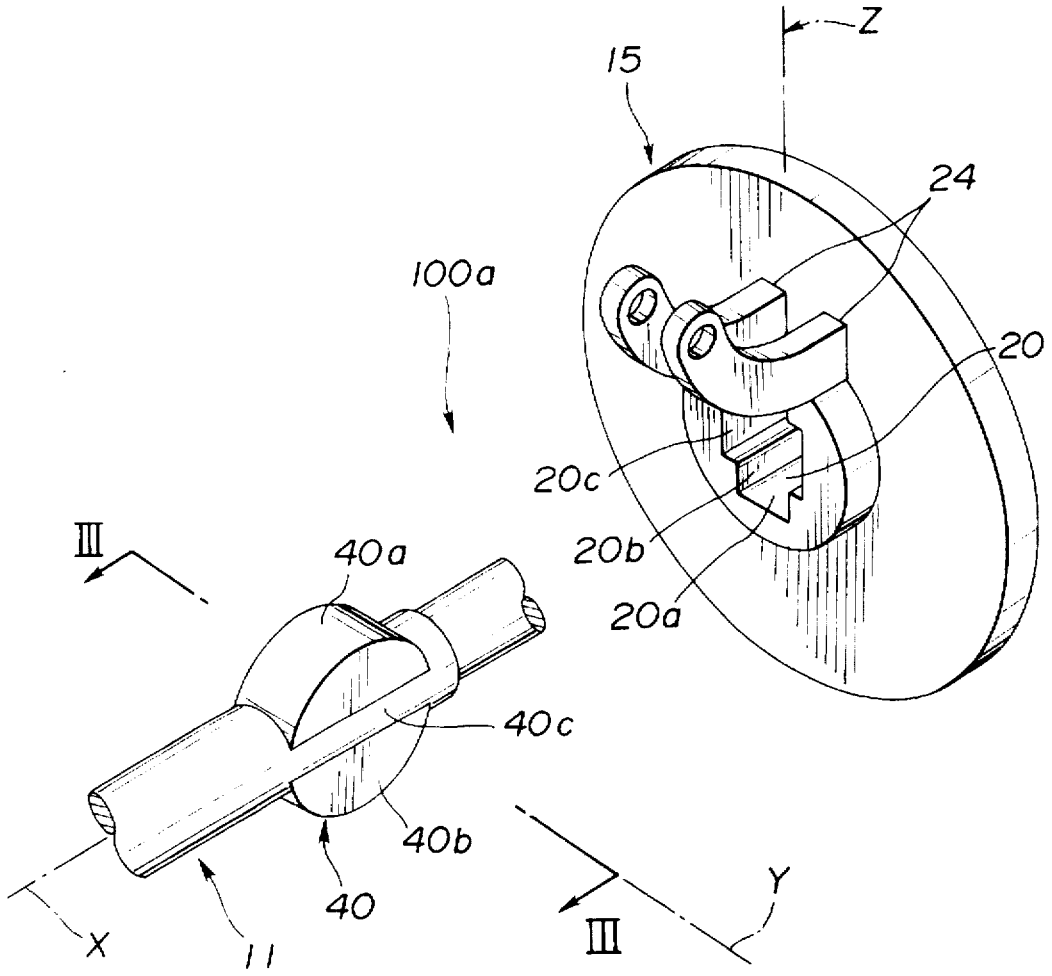
FIG. 2 is a partial and exploded view of a coupling structure employed in the compressor of the first embodiment.
Figure 3:
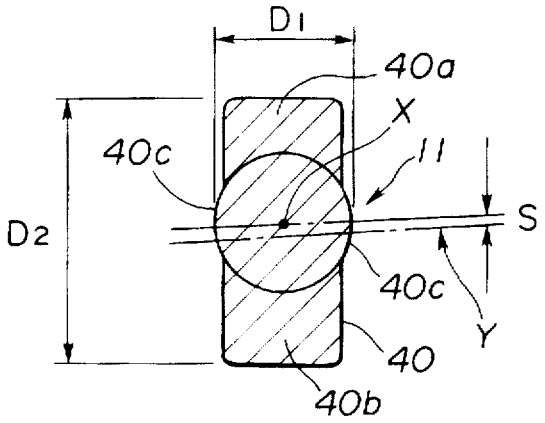
FIG. 3 is a sectional view taken along the line III—III of FIG. 2.

Referring to FIGS. 1 to 3, particularly FIG. 1, there is shown a variable displacement swash plate type compressor 100A which is a first embodiment of the present invention.

Figure 15:
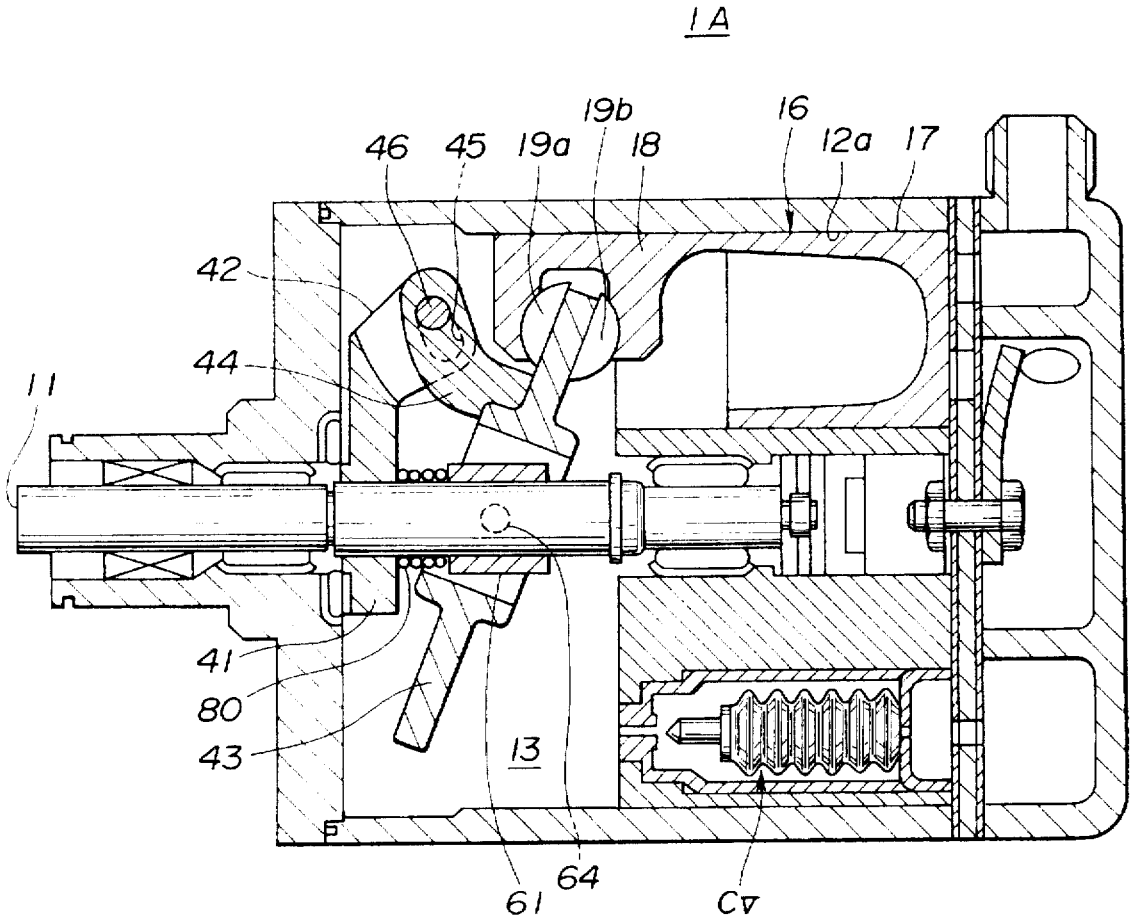
FIG.15 (PRIOR ART)
FIG. 15 is a sectional view of a conventional variable displacement swash plate type compressor.
Figure 16:
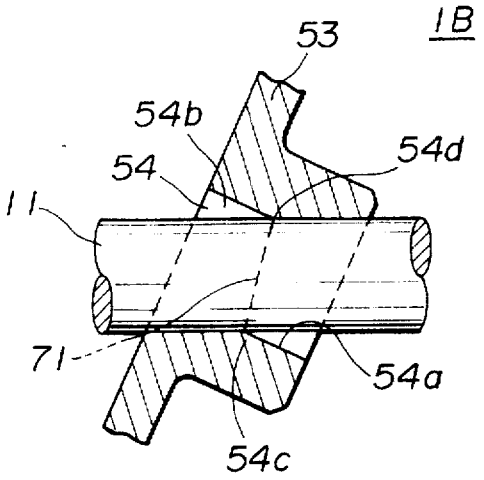
FIG.16 (PRIOR ART)
FIGS. 16 and 17 are partial sectional views of a coupling structure which is employed in another conventional variable displacement swash plate type compressor.
Figure 17:
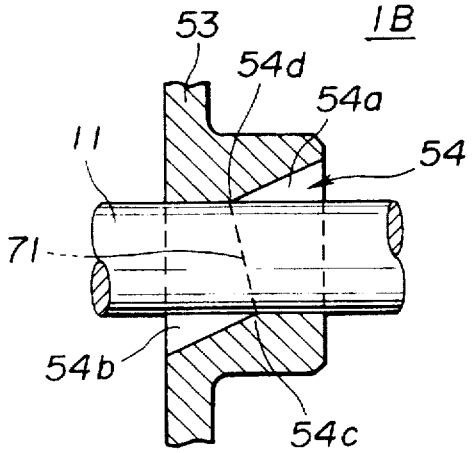
FIG.17 (PRIOR ART)

For ease of description, substantially the same parts as those of the above-mentioned conventional compressor 1A of FIG. 15 are designated by the same numerals and detailed explanation of them will be omitted from the following.

As is seen from FIG. 1, the compressor 100A comprises a drive shaft 11 which is installed in and rotatably supported by a cylindrical casing 12. The drive shaft 11 is driven by an engine (not shown) through a known mechanism. A front cover 14*f* is secured to a left open end of the cylindrical casing 12 and a rear cover 14*r* is secured to a right open end of the casing 12. With this, a crank chamber 13 is defined in the cylindrical casing 12, as shown. The rear cover 14*r* has a discharge chamber 26 formed therein, as shown.

Within the crank chamber 13, there is installed a swash plate 15 which is disposed about the drive shaft 11 to rotate therewith. Within the cylindrical casing 12, there are formed a plurality of cylinder bores 12*a* which are arranged about an axis of the drive shaft 11 at evenly spaced intervals. Each cylinder bore 12*a* has a piston 16 slidably received therein. The piston 16 comprises a head portion 17 which is slidably received in the cylinder bore 12*a* and a stem portion 18 which is exposed to the crank chamber 13. The stem portion 18 has a shoe holding portion which comprises two holding arms by which two semi-spherical shoes 19*a* and 19*b* are slidably held. The shoes 19*a* and 19*b* slidably put therebetween a peripheral part 15*a* of the swash plate 15. As shown, when the two semi-spherical shoes 19*a* and 19*b* are properly assembled, the spherical outer surfaces of them constitute a part of an entire outer surface of a single sphere.

The shoe holding portion of the stem portion 18 of each piston 16 has at a back side thereof a rotation stopper portion 18*a*. The rotation stopper portion 18*a* is slidably engageable with an inner surface 12*b* of the cylindrical casing 12 to suppress a rotational movement of the piston 16 about the axis of the same.

A supporting bracket 21 is secured at a base portion thereof to the drive shaft 11 to rotate therewith. The supporting bracket 21 has at a leading end a drive arm 22.

As is seen in FIG. 2, two driven arms 24 are secured to the swash plate 15. The driven arms 24 have a hinge pin 25 (see FIG. 1) secured thereto, which pin is slidably received in an elongate slot 23 formed in the drive arm 22.

With this, a so-called hinge mechanism "H" (see FIG. 1) is provided between the supporting bracket 21 and the swash plate 15. That is, under rotation of the drive shaft 11, the swash plate 15 is rotated together with the drive shaft 11 and pivotal relative to the drive shaft 11 making the hinge pin 25 as a pivot center.

As shown in FIG. 1, between the crank chamber 13 and an intake chamber 32 defined in the rear cover 14*r*, there is defined a passage "R" in which a pressure regulating valve "Cv" of bellows type is arranged. Due to operation of the valve "Cv", the passage "R" is closed and opened. That is, in accordance with the pressure of a refrigerant vapor returned to the intake chamber 32, the bellows expands and contracts to close and open the passage "R" and thus controls the pressure in the crank chamber 13. In accordance with the pressure in the crank chamber 13, the inclination angle of the swash plate 15 relative to the drive shaft 11 is varied and thus the amount of compressed refrigerant vapor discharged from the compressor 100A is controlled.

Denoted by numeral 30 is an intake port and 31 is a discharge port which are incorporated with the cylinder bore 12*a*. Although not shown in the drawing, corresponding intake and discharge ports are provided for the remaining cylinder bores 12*a*.

In the following, features of the first embodiment 100A will be described with reference to FIGS. 1 to 3.

In FIG. 2, an improved coupling structure 100*a* employed in the first embodiment 100A is shown. The coupling structure 100*a* comprises a drum-like bearing portion 40 integrally formed on the drive shaft 11. As will become apparent hereinafter, the drum-like bearing portion 40 is slidably received in a center bore 20 formed in the swash plate 15. The bearing portion 40 comprises two semicylindrical parts 40*a* and 40*b* which are arranged to project in opposite directions from an axis "X" of the drive shaft 11. The two semicylindrical parts 40*a* and 40*b* have a common axis "Y" which extends in parallel with the axis of the hinge pin 25 (see FIG. 1).

The center bore 20 of the swash plate 15 has upper and lower flat walls 20*a* to which cylindrical walls of the two semicylindrical parts 40*a* and 40*b* slidably contact, upper and lower paired flat side walls 20*b* to which side walls of the two semicylindrical parts 40*a* and 40*b* slidably contact, and center paired recesses 20*c* in which side projections or side ridges 40*c* of the bearing portion 40 are loosely received. As is seen from FIG. 3, the side ridges 40*c* are diametrically opposed parts of the cylindrical wall of the drive shaft 11. A broaching technique may be used for providing the swash plate 15 with the center bore 20.

As is understood from FIG. 1, in assembly, the drum-like bearing portion 40 is slidably received in the center bore 20 of the swash plate 15. That is, upon assembly, the swash plate 15 can move along the axis "X" of the drive shaft 11 while pivoting about bearing portion 40.

Because the bearing portion 40 has a cylindrical outer surface, the pivoting movement of the swash plate 15 about the bearing portion 40 is smoothly made.

As is seen from FIG. 3, if desired, the axis "Y" may be positioned below the axis "X" by a given distance "S". With this distance "S", a vertical displacement of the swash plate 15, which would inevitably occur when the swash plate 15 pivots about the bearing portion 40, is evenly carried out throughout the pivoting movement.

As is understood from FIG. 3, the diameter "D2" of the bearing portion 40 is greater than the diameter "D1" of the drive shaft 11. The diameter "D2" of the bearing portion 40 is so determined as to assure the slidable contact with the upper and lower flat walls 20*a* of the center bore 20 of the swash plate 15 irrespective of any inclined position which the swash plate 15 assumes.

As will be understood from FIG. 2, the upper and lower flat paired side walls 20*b* of the center bore 20 of the swash plate 15 make a so-called "large surface contact" with the side walls of the bearing portion 40. Thus, a play of the swash plate 15 about a vertical axis "Z" is assuredly suppressed. This means that the hinge mechanism "H" (see FIG. 1) has no need of providing any function to suppress such play. That is, the hinge mechanism "H" employed in the first embodiment 100A can have a simple construction.

In this embodiment, the torque transmission from the drive shaft 11 to the swash plate 15 is carried out through two independent paths, one being through the hinge mechanism "H" and the other being through the bearing portion 40. Thus, the torque transmission is reliably carried out.

Figure 4:
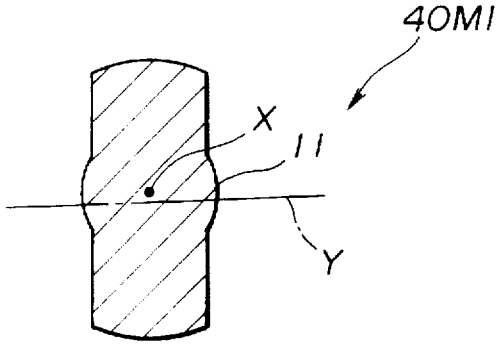
FIGS. 4 and 5 are views similar to FIG. 3, but showing modifications of the coupling structure of the first embodiment.
Figure 5:
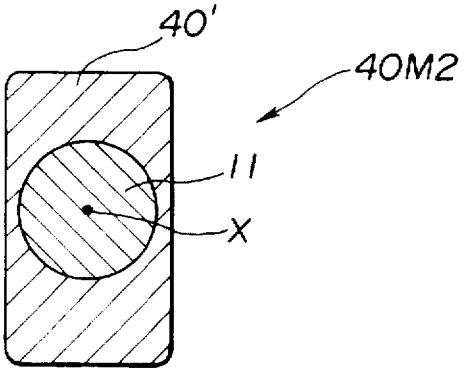

FIGS. 4 and 5 show modifications 40M1 and 40M2 of the bearing portion 40. In the modification 40M1 of FIG. 4, the outer cylindrical wall has a radius of curvature in the direction of the axis "Y". That is, the bearing portion 40M1 has a spherical outer surface. In the modification 40M2 of FIG. 5, a separate bearing member 40' is employed, which is tightly disposed on the drive shaft 11.

In the following, operation of the above-mentioned compressor 100A of the first embodiment will be outlined with reference to FIG. 1.

When, for operating a cooling section of an automotive air conditioning system, the drive shaft 11 is driven by the engine, the swash plate 15 is rotated together with the drive shaft 11 while assuming a certain inclined position relative to the drive shaft 11. Due to the turns of the swash plate 15, each piston 16 is forced to make reciprocating movement in the corresponding cylinder bore 12*a*, and thus, the refrigerant vapor from an evaporator (not shown) is sucked into the cylinder bores 12*a* through the intake chamber 32 and the intake ports 30. After being compressed by the pistons 16 in the cylinder bores 12*a*, the compressed refrigerant vapor is discharged to the discharge chamber 26 through the discharge ports 31. The compressed refrigerant vapor in the discharge chamber 26 is then supplied to a condenser (not shown) to be condensed.

Under a severe cooling load, it is necessary to compress a larger amount of refrigerant vapor. In this case, the pressure of the refrigerant vapor led to the intake chamber 32 is relatively high and thus the pressure in the passage "R" is high. Under this condition, the bellows of the pressure regulating valve "Cv" is contracted and thus opens the passage "R". As a result, the pressure in the crank chamber 13 becomes equal to that in the intake chamber 32. In other words, the pressure in the crank chamber 13 is lowered.

During operation of the compressor 100A, the pressure in the crank chamber 13 applies to a left end (as viewed in FIG. 1) of each piston 16 and the pressure in a compression chamber of the corresponding cylinder bore 12*a* applies to a right end of the piston 16. Thus, each piston 16 is pressed toward a lower pressure side with a force corresponding to the pressure difference therebetween. The forces applied to all the pistons 16 are added to determine the inclination angle of the swash plate 15.

When, as is described hereinabove, the pressure in the crank chamber 13 becomes lowered, the force for pressing each piston 16 leftward in FIG. 1, that is, toward the swash plate 15 is increased. That is, the swash plate 15 is biased leftward. However, due to provision and function of the hinge mechanism "H", the biasing force thus applied to the swash plate 15 causes the same to be inclined largely about the axis of the pin 25. Under this condition, each piston 16 is forced to have a long stroke, and thus, the displacement of the compressor 100A is increased.

Under a lower cooling load, it is only necessary to compress a smaller amount of refrigerant vapor. In this case, the pressure of the refrigerant vapor led to the intake chamber 32 is relatively low, and thus, the pressure in the passage "R" is low. Under this condition, the bellows of the pressure regulating valve "Cv" is expanded and thus closes the passage "R". As a result, the pressure in the crank chamber 13 becomes isolated from the intake chamber 32. In this state, the pressure in the crank chamber 13 is gradually increased due to penetration of high pressure vapor thereinto through a clearance between each piston 1 and the corresponding cylinder bore 12*a*.

When the pressure in the crank chamber 13 is increased and the pressure becomes higher than that in the compression chamber of each cylinder bore 12*a*, the force for pressing each piston leftward, that is, toward the swash plate 15 is lowered. Accordingly, due to the force of a coil spring 80, the swash plate 15 is moved rightward reducing the inclination angle thereof relative to the drive shaft 11. Under this condition, each piston 16 is forced to have a short stroke, and thus, the displacement of the compressor 100A is lowered.

In the following, advantages of the first embodiment 100A will be described.

(1) As is described hereinabove, the sliding movement of the swash plate 15 along the drive shaft 11 as well as the pivoting movement of the swash plate 15 relative to the drive shaft 11 are smoothly achieved with the coupling structure 100*a* which has a simple structure. In fact, such coupling structure 100*a* has no parts corresponding to the sleeve 61 and the two pins 64 employed in the conventional compressor 1A of FIG. 15. Thus, production cost can be reduced in the invention.

(2) The center bore 20 of the swash plate 15 makes a so-called "large surface contact" with the drum-like bearing portion 40 of the drive shaft. Thus, undesired play of the swash plate 15 relative to the drive shaft 11 is assuredly suppressed. Furthermore, bearing stress applied to the contact surface is lowered and thus undesired abrasion of the mutually contacting parts is minimized.

(3) The torque transmission from the drive shaft 11 to the swash plate 15 is carried out through two independent transmission paths, one being through the hinge mechanism "H" and the other being through the bearing portion 40. Thus, the torque transmission is assuredly achieved.

Figure 6:
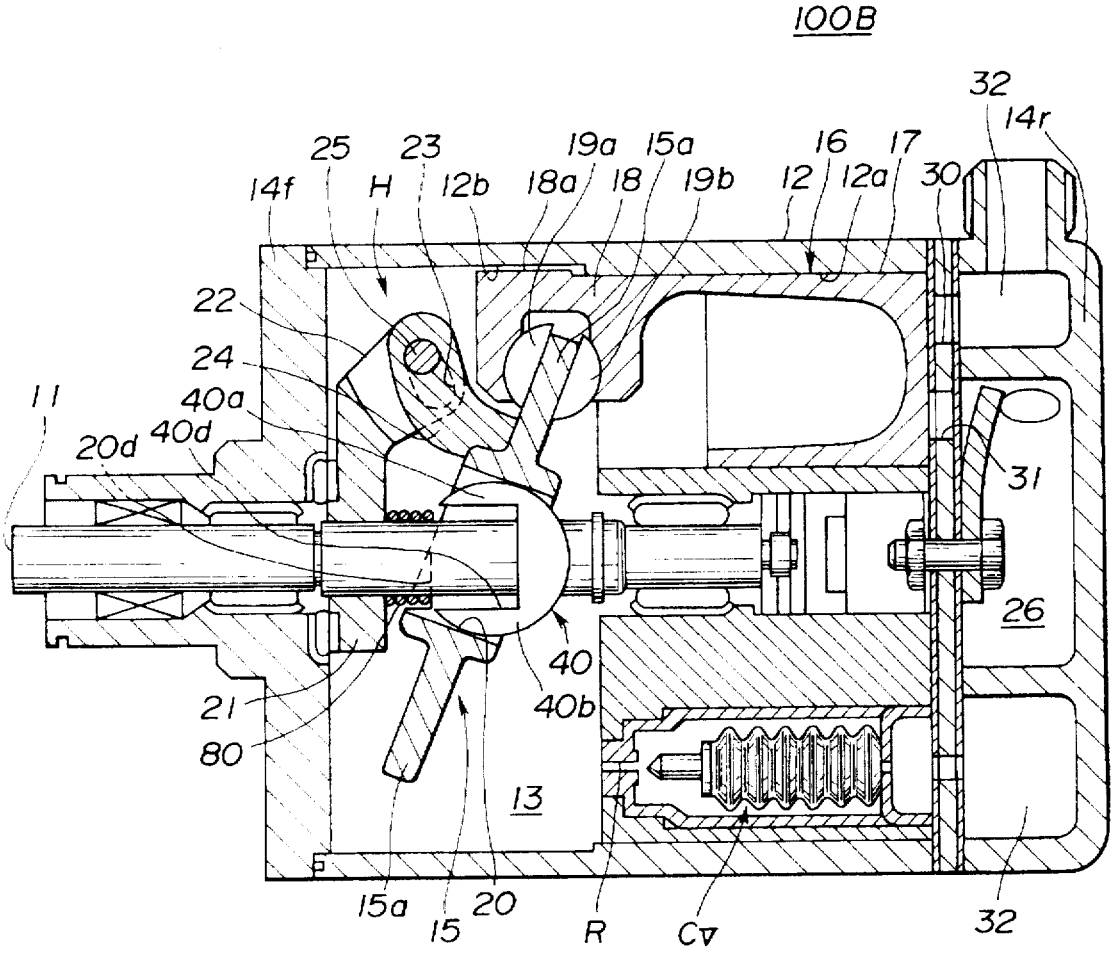
FIG. 6 is a sectional view of a variable displacement swash plate type compressor which is a second embodiment of the present invention.
Figure 7:
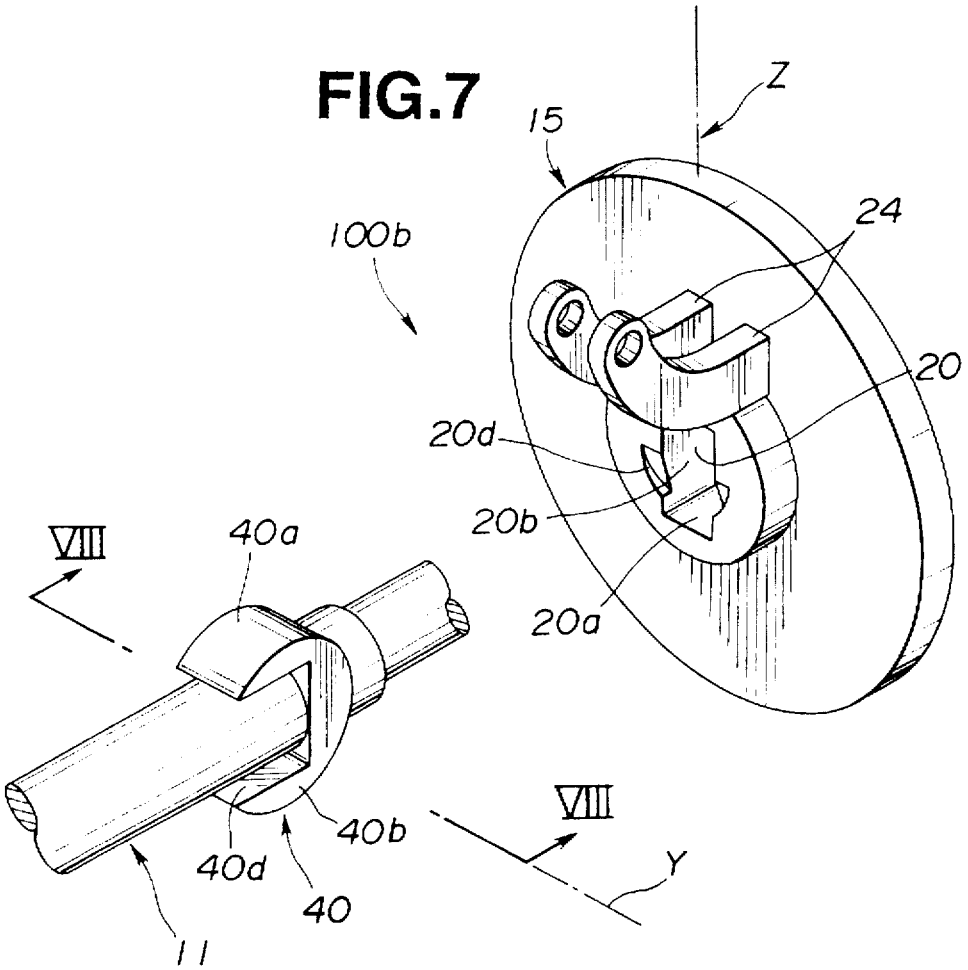
FIG. 7 is a partial and exploded view of a coupling structure employed in the compressor of the second embodiment.
Figure 8:
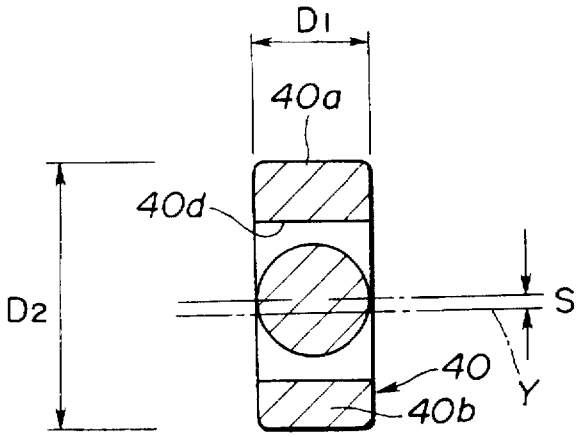
FIG. 8 is a sectional view taken along the line VIII—VIII of FIG. 7.

Referring to FIGS. 6 to 8, particularly FIG. 6, there is shown a variable displacement swash plate type compressor 100B which is a second embodiment of the present invention.

Since this second embodiment 100B is similar to the above-mentioned first embodiment 100A, only portions and parts which are different from those of the first embodiment 100A will be described for ease of description.

That is, as is seen from FIG. 7, a coupling structure 100*b* employed in the second embodiment 100B differs from that of the first embodiment 100A. As will become apparent hereinafter, in the coupling structure 100*b* of the second embodiment 100B, a measure is employed for assuring engagement between the coil spring 80 and the swash plate 15 even when the swash plate 15 assumes the non-inclined position.

As is shown in FIG. 7, the bearing portion 40 is formed with a rectangular recess 40*d* which faces toward the coil spring 80 (see FIG. 6) and accommodates a part of the drive shaft 11. The bearing portion 40 has no portions corresponding to the side ridges 40*c* (see FIG. 2) of the first embodiment. That is, in the second embodiment 100B, the thickness of the bearing portion 40 is equal to the diameter of the drive shaft 11, as is well seen from FIG. 8.

As is understood from FIG. 6, the rectangular recess 40*d* is so sized as to freely receive the coil spring 80 when the latter expands toward the bearing portion 40.

The center bore 20 of the swash plate 15 has a rectangular cross section, which is thus defined by upper and lower flat walls 20*a* and two side walls 20*b*. A semicircular recess 20*d* is formed on the hub portion of the swash plate 15 for receiving one end of the coil spring 80.

As is seen from FIG. 8, similar to the case of the first embodiment (see FIG. 3), the axis "Y" may be positioned below the axis "X" by a given distance "S".

Due to provision of the recess 40*d*, abutment of the coil spring 80 with the bearing portion 40 is suppressed, which assures an operational abutment of the coil spring 80 with the hub portion of the swash plate 15.

Figure 9:
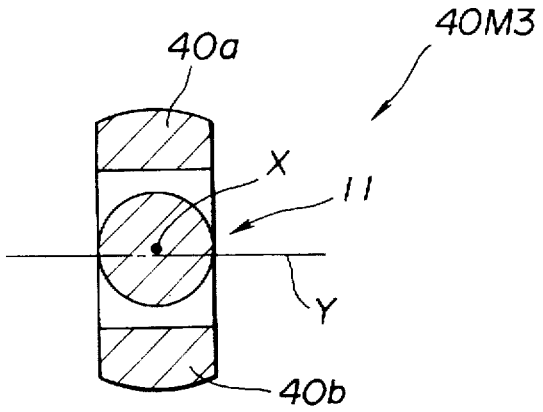
FIGS. 9 and 10 are views similar to FIG. 8, but showing modifications of the coupling structure of the second embodiment.
Figure 10:
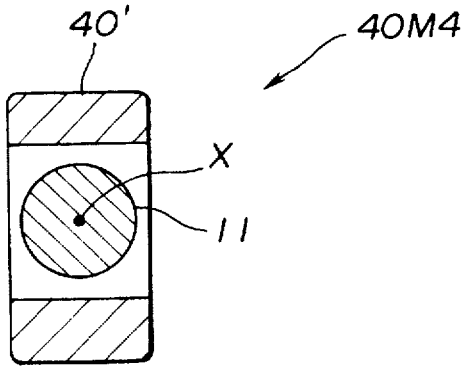

FIGS. 9 and 10 show modifications 40M3 and 40M4 of the bearing portion 40. In the modification 40M3 of FIG. 9, the outer cylindrical wall has a radius of curvature in the direction of the axis "Y". That is, the bearing portion 40M3 has a spherical outer surface. In the modification 40M4 of FIG. 10, a separate bearing member 40' is employed, which is tightly disposed on the drive shaft 11.

It is easily understood that the advantages of the first embodiment 100A are equally possessed by the second embodiment 100B.

Figure 11:
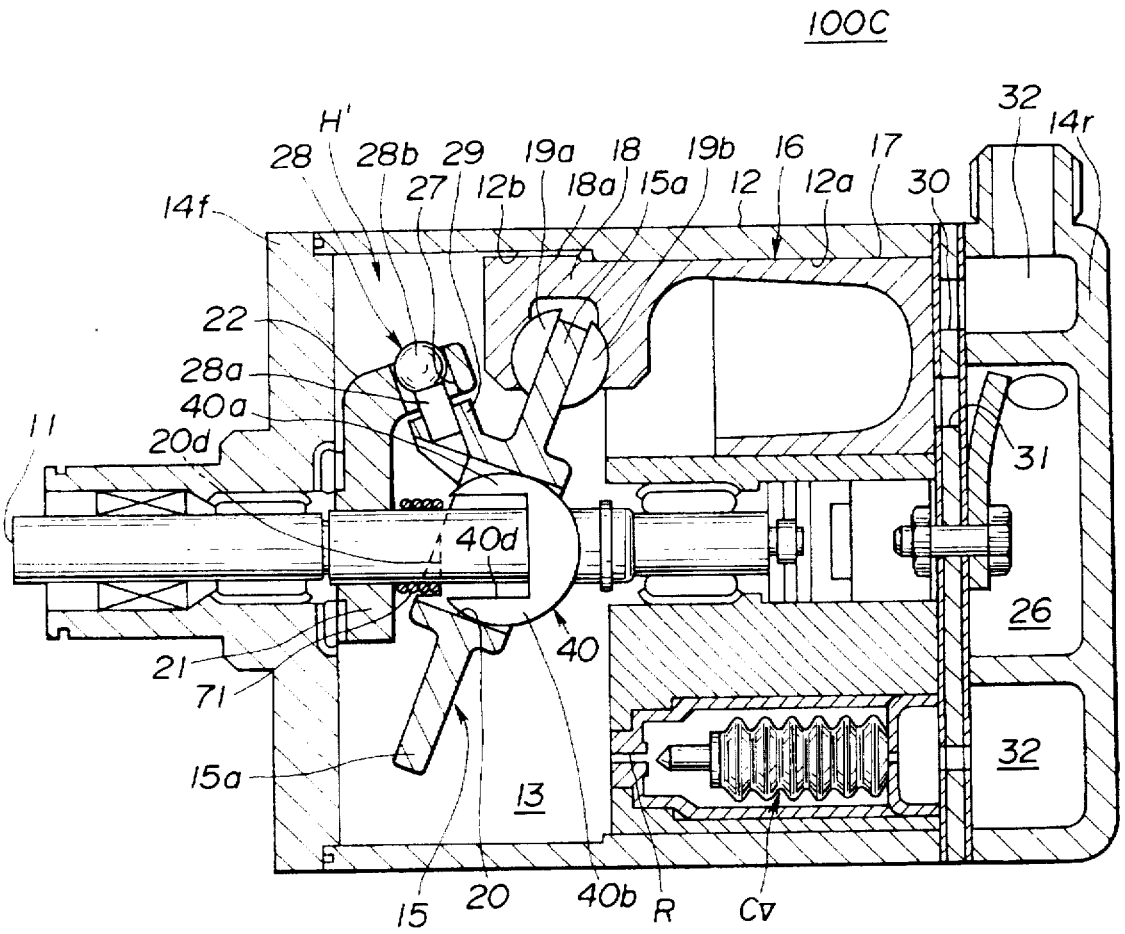
FIG. 11 is a sectional view of a variable displacement swash plate type compressor which is a third embodiment of the present invention.
Figure 12:
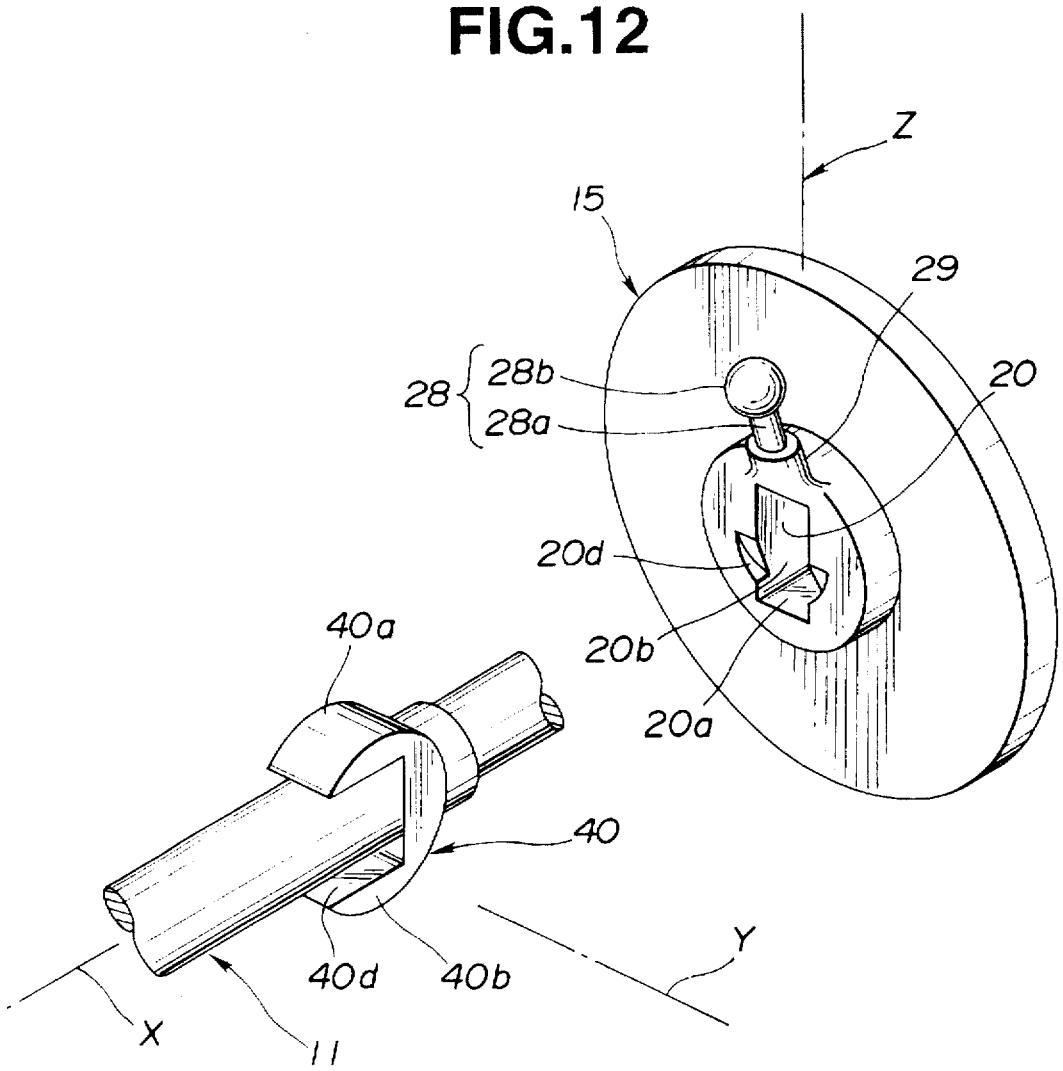
FIG. 12 is a partial and exploded view of a coupling structure employed in the compressor of the third embodiment.

Referring to FIGS. 11 and 12, particularly FIG. 11, there is shown a variable displacement swash plate type compressor 100C which is a third embodiment of the present invention.

Since this third embodiment 100C is similar to the above-mentioned second embodiment 100B, only portions and parts which are different from those of the second embodiment 100B will be described for ease of description.

That is, a hinge mechanism H' employed in the third embodiment differs from that of the second embodiment 100B.

As is seen from FIG. 11, the hinge mechanism H' comprises a cylindrical bore 27 formed in the drive arm 22 of the supporting bracket 21. Movably and slidably received in the bore 27 is a spherical head 28*b* (see FIG. 12) of a guide pin 28. A shaft portion 28*a* of the guide pin 28 is secured to the hub portion of the swash plate 15. More specifically, as shown in FIG. 12, a base part of the shaft portion 28*a* is tightly pressed into an apertured stub portion 29 which is formed on the hub portion of the swash plate 15. Of course, the shaft portion 28*a* may be screwed into a threaded aperture formed in the stub portion 29.

In the third embodiment 100C, the hinge mechanism H' employs a so-called ball-and-socket universal joint. It is to be noted that such hinge mechanism H' is used only in a case wherein, like in the above-mentioned first and second embodiments 100A and 100B, the torque transmission from the drive shaft 11 to the swash plate 15 can be made by only the coupling structure 100*a* or 100*b*.

Due to the similar construction, the advantages of the second embodiment 100B are equally possessed by the third embodiment 100C.

Figure 13:
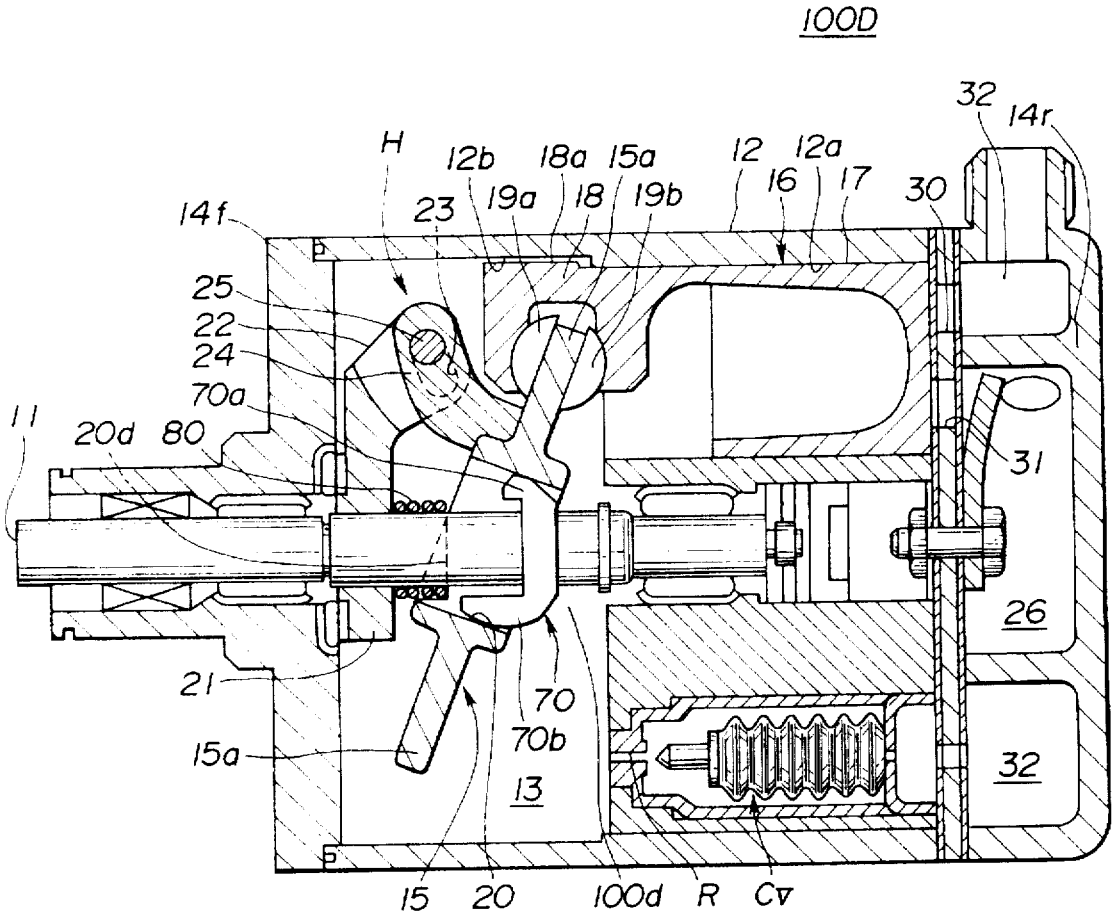
FIG. 13 is a sectional view of a variable displacement type swash plate type compressor which is a fourth embodiment of the present invention.
Figure 14:
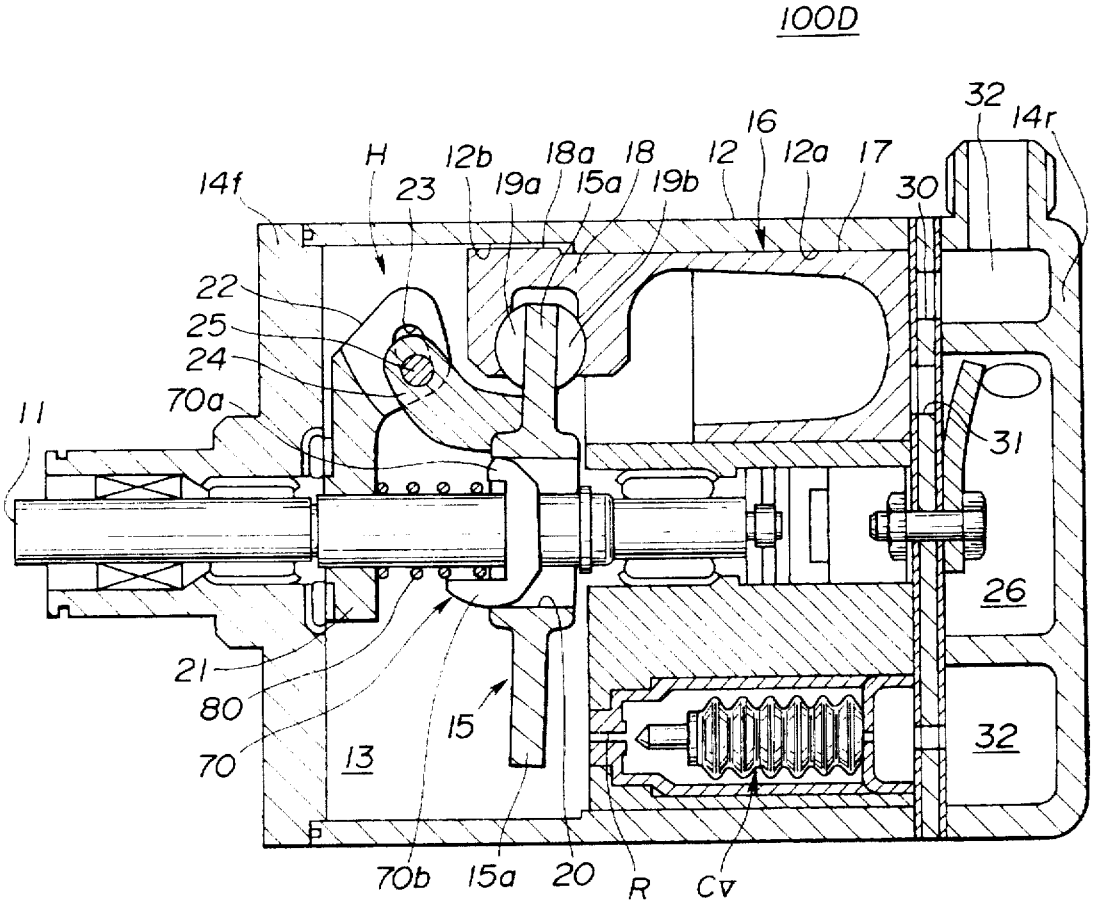
FIG. 14 is a view similar to FIG. 13, but showing a different condition of the fourth embodiment.

Referring to FIGS. 13 and 14, there is shown a variable displacement swash plate type compressor 100D which is a fourth embodiment of the present invention.

Since this fourth embodiment 100D is similar to the above-mentioned second embodiment 100B, only portions and parts which are different from those of the second embodiment 100B will be described.

That is, a coupling structure 100*d* employed in this fourth embodiment 100D is somewhat different from that of the second embodiment 100B. In this fourth embodiment 100D, a cam member 70 is integrally formed on the drive shaft 11, which comprises a shorter arm 70*a* and a longer arm 70*b*. The shorter and longer arms 70*a* and 70*b* are arranged to define therebetween a given clearance for suppressing engagement with the coil spring 80 irrespective of any inclined position which the swash plate 15 assumes. The arms 70*a* are 70*b* have respective cam surfaces which are slidably engaged with the upper and lower flat walls 20*a* of the center bore 20 of the swash plate 15. It is to be noted that the arm 70*a* which is closer to the hinge mechanism "H" than the arm 70*b* has a shorter length.

Due to the similar construction, the advantages of the second embodiment 100B are equally possessed by the fourth embodiment 100D. More specifically, in the fourth embodiment 100D, the production cost can be more reduced due to the quite simple construction of the coupling structure 100*d*.

What is claimed is:

1. A variable displacement swash plate type compressor comprising:

a casing having a plurality of cylinder bores circumferentially arranged therein;

a plurality of pistons incorporated with the cylinder bores respectively;

a drive shaft extending in said casing;

a swash plate disposed about said drive shaft;

a hinge mechanism for achieving a hinged connection between said drive shaft and said swash plate;

means for making a hinged and slidable connection between the swash plate and each of the pistons to make a reciprocating movement of each piston when the swash plate is rotated together with said drive shaft;

a coil spring disposed about drive shaft for biasing said swash plate in a given direction; and a coupling structure arranged between said drive shaft and said swash plate in order to allow said swash plate to be movable along the drive shaft and inclinable relative to the same, said coupling structure including:

a bearing portion provided on said drive shaft to rotate therewith, said bearing portion including first and second semicylindrical outer walls which are symmetrically arranged with respect to an axis of said drive shaft and first and second flat side walls which are symmetrically arranged with respect to said axis, each of said first and second semicylindrical outer walls being perpendicular to each of said first and second flat side walls; and means defining a center bore in a hub portion of said swash plate, said center bore being so sized and shaped as to intimately and slidably receive therein said bearing portion.

2. A variable displacement swash plate type compressor as claimed in claim 1, in which said center bore of said swash plate has a rectangular cross section and is defined by:

third and fourth flat walls which are slidably engaged with said first and second semicylindrical outer walls respectively; and third and fourth flat side walls which are slidably engaged with said first and second flat side walls respectively.

3. A variable displacement swash plate type compressor as claimed in claim 2, in which said bearing portion is formed with a recess for suppressing engagement with said coil spring irrespective of any inclined position which said swash plate assumes.

4. A variable displacement swash plate type compressor as claimed in claim 3, in which said recess is rectangular in shape and faces toward said coil spring.

5. A variable displacement swash plate type compressor as claimed in claim 4, in which the hub portion of said swash plate is formed with a semicircular recess for seating therein one end of said coil spring.

6. A variable displacement swash plate type compressor as claimed in claim 1, in which said hinge mechanism comprises:

a supporting bracket secured to said drive shaft to rotate therewith, said supporting bracket being at a leading end portion thereof formed with a cylindrical bore;

a guide pin secured to the hub portion of said swash plate, said guide pin having a spherical head which is movably and slidably received in the cylindrical bore of said supporting bracket.

7. A variable displacement swash plate type compressor as claimed in claim 6, in which said guide pin has a shaft portion which is tightly pressed into an apertured stub portion formed on the hub portion of said swash plate.

8. A variable displacement swash plate type compressor as claimed in claim 2, in which said bearing portion is shaped like a cam member, said cam member including shorter and longer arms which are arranged at opposite positions with respect to the axis of said drive shaft, each arm extending toward said coil spring, said shorter and longer arms defining therebetween a given clearance for suppressing engagement with said coil spring irrespective of any inclined position which said swash plate assumes, said shorter and longer arms having respective cam surfaces which are slidably engaged the third and fourth flat walls of said center bore of said swash plate.

9. A variable displacement swash plate type compressor as claimed in claim 1, in which the first and second semicylindrical outer walls of said bearing portion constitute substantially the cylindrical wall of an imaginary right cylinder.

10. A variable displacement swash plate type compressor as claimed in claim 9, in which an axis of said imaginary right cylinder and the axis of said drive shaft intersect at right angles.

11. A variable displacement swash plate type compressor as claimed in claim 9, in which an axis of said imaginary right cylinder is perpendicular to the axis of said drive shaft and separated from the same.

12. A variable displacement swash plate type compressor as claimed in claim 1, in which said bearing portion is integral with said drive shaft.

13. A variable displacement swash plate type compressor as claimed in claim 1, in which said bearing portion is a separate member which is tightly disposed on said drive shaft.

14. A variable displacement swash plate type compressor as claimed in claim 2, in which said bearing portion further includes first and second side ridges which are symmetrically arranged with respect to the axis of said drive shaft and extend on the first and second flat side walls of said bearing portion, and in which said center bore is further defined by third and fourth recesses in which said first and second side ridges are loosely received.

15. A variable displacement swash plate type compressor as claimed in claim 14, in which said first and second side ridges constitute diametrically opposed portions of said drive shaft.

16. A variable displacement swash plate type compressor as claimed in claim 1, in which each of said first and second semicylindrical outer walls of said bearing portion has a spherical surface.

17. A variable displacement swash plate type compressor as claimed in claim 1, in which said first and second semicylindrical outer walls of said bearing portion has a common axis in parallel with a hinge axis defined by said hinge mechanism.

18. A variable displacement swash plate type compressor as claimed in claim 1, in which said hinge mechanism comprises:

a supporting bracket secured to said drive shaft to rotate therewith, said supporting bracket having at a leading end portion an elongate slot;

two arms secured to said swash plate; and a hinge pin secured to leading ends of said two arms while passing through said elongate slot.

* * * * *